US005556255A

United States Patent [19]

Kieffer

[11] Patent Number: 5,556,255

[45] Date of Patent: Sep. 17, 1996

[54] INTEGRAL THREADED TURBINE OUTLET

[75] Inventor: Joseph W. Kieffer, Rogers, Minn.

[73] Assignee: Wagner Spray Tech Corporation, Minneapolis, Minn.

[21] Appl. No.: 389,093

[22] Filed: Feb. 15, 1995

Related U.S. Application Data

[63] Continuation-in-part of Ser. No. 335,003, Nov. 9, 1994.

[51] Int. Cl.[6] ..... F04D 29/62; F04D 29/00

[52] U.S. Cl. ..... 415/212.1; 415/206; 411/412

[58] Field of Search ..... 239/346; 415/206, 415/212.1, 215.1; 411/412, 413, 417

[56] References Cited

U.S. PATENT DOCUMENTS

| | | | |
|---|---|---|---|
| 1,929,496 | 10/1933 | Jacuzzi | 415/206 |
| 2,643,615 | 6/1953 | Murphy et al. | 415/206 |
| 3,095,821 | 7/1963 | Elenbaas | 415/206 |
| 4,521,155 | 6/1985 | Osborn | 415/190 |
| 4,790,702 | 12/1988 | Maganias | 411/412 |
| 4,877,364 | 10/1989 | Sorrentino | 411/412 |
| 5,100,288 | 3/1992 | Stanislao | 415/206 |

*Primary Examiner*—Edward K. Look
*Assistant Examiner*—Michael S. Lee
*Attorney, Agent, or Firm*—Faegre & Benson LLP

[57] ABSTRACT

A integrally threaded outlet for a turbine for paint spraying equipment of the type having a die cast turbine to provide air for operation with a portable paint spraying gun, the threaded outlet integrally formed on an extension projecting tangentially of the turbine enclosure and having a diameter approximately the same as a flexible hose coupling the turbine to the portable paint spraying gun.

5 Claims, 7 Drawing Sheets

INTEGRAL THREADED TURBINE OUTLET

CROSS-REFERENCE TO RELATED APPLICATION

This application is a Continuation-In-Part of application Ser. No. 08/335,003, filed Nov. 9, 1994.

BACKGROUND OF THE INVENTION

This invention relates to an integrally threaded outlet for turbines for use with paint-spraying equipment, particularly non-bleeder air atomization assisted paint spray guns. Turbines used in prior art systems typically had a relatively large diameter exhaust opening. A separate reducer was required to match the diameter of the hose connecting the outlet of the turbine with the paint gun. The reducer typically provided a threaded fitting to permit easy and rapid attachment and detachment of the hose from the turbine. In addition, in such systems having air supplied from a portable turbine, when the gun is not triggered (shutting off atomization air) means must ordinarily be provided to dump or bleed air from the turbine (or other measures taken) to protect the turbine from over-speeding and over-heating due to the blocked outlet. One approach is to provide a bleed-air discharge from the turbine at all times to prevent these undesirable results. However, using the bleed air approach also introduces a complication of introducing an additional source of relatively high frequency noise resulting from the restriction associated with the bleed-air orifice.

The present invention is directed to eliminating the need for a separate reducer by providing that the outlet of the turbine be sized to match the hose and furthermore be provided with threads to both enable easy coupling with the hose and to provide a simple and secure means of attachment of the turbine outlet to the exterior enclosure.

DETAILED DESCRIPTION OF THE INVENTION

Figure 1:
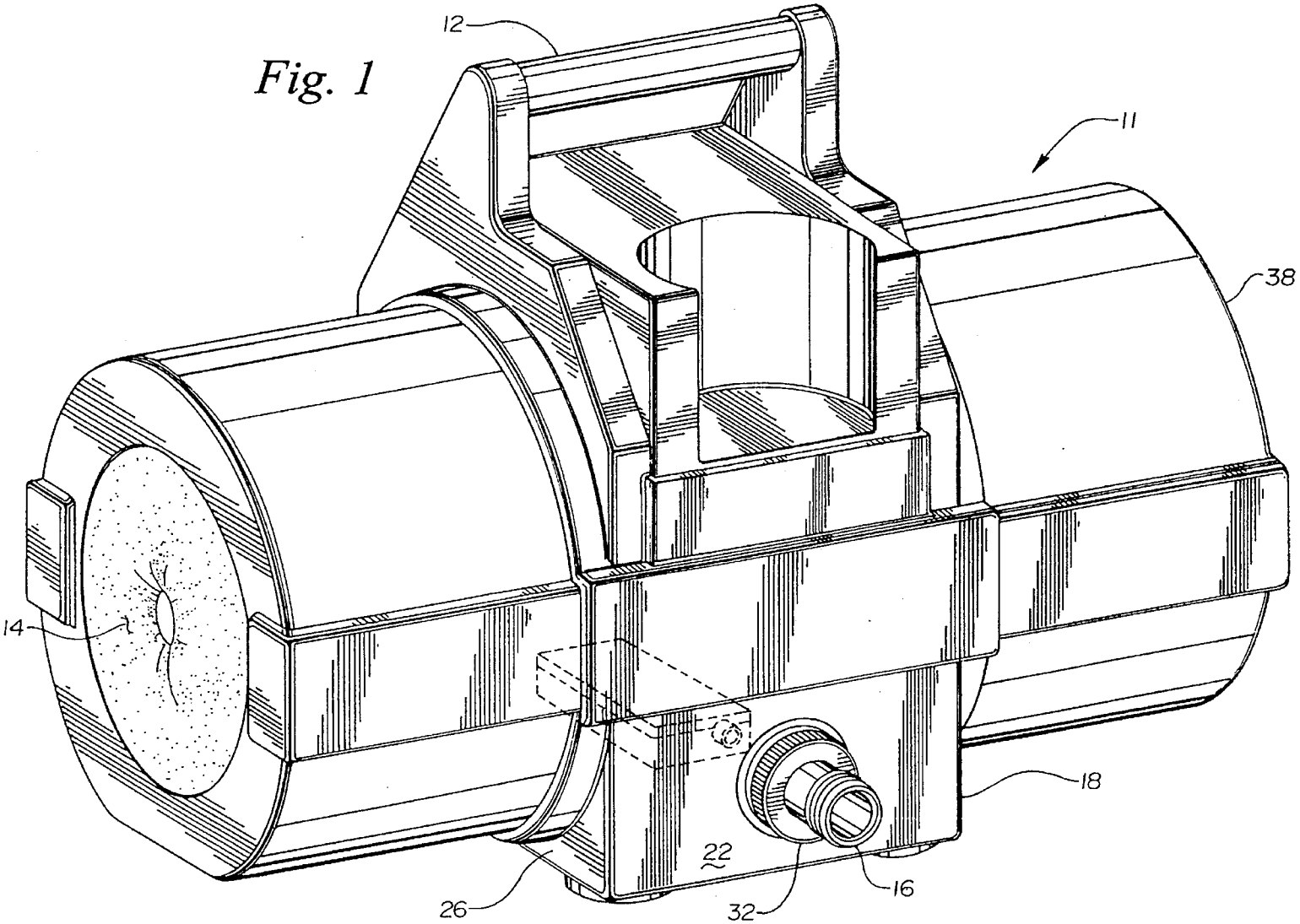
FIG. 1 is a perspective view of a turbine housing useful in the practice of the present invention.

Referring now to the Figures, particularly FIG. 1, a turbine housing 11 useful in the practice of the present invention may be seen. It is to be understood that turbine housing 11 houses a turbine 40 (shown in FIGS. 5 and 6) which is portable, evidenced by handle 12, and preferably has an air intake filter 14 and an air outlet 16. Air outlet 16 is preferably connected via a hose (not shown) to a hand-held paint spray gun (not shown) such as an HVLP type which uses air to atomize paint. Air outlet 16 is formed integrally with the turbine enclosure 17, all of which is preferably an aluminum die casting.

Figure 2:
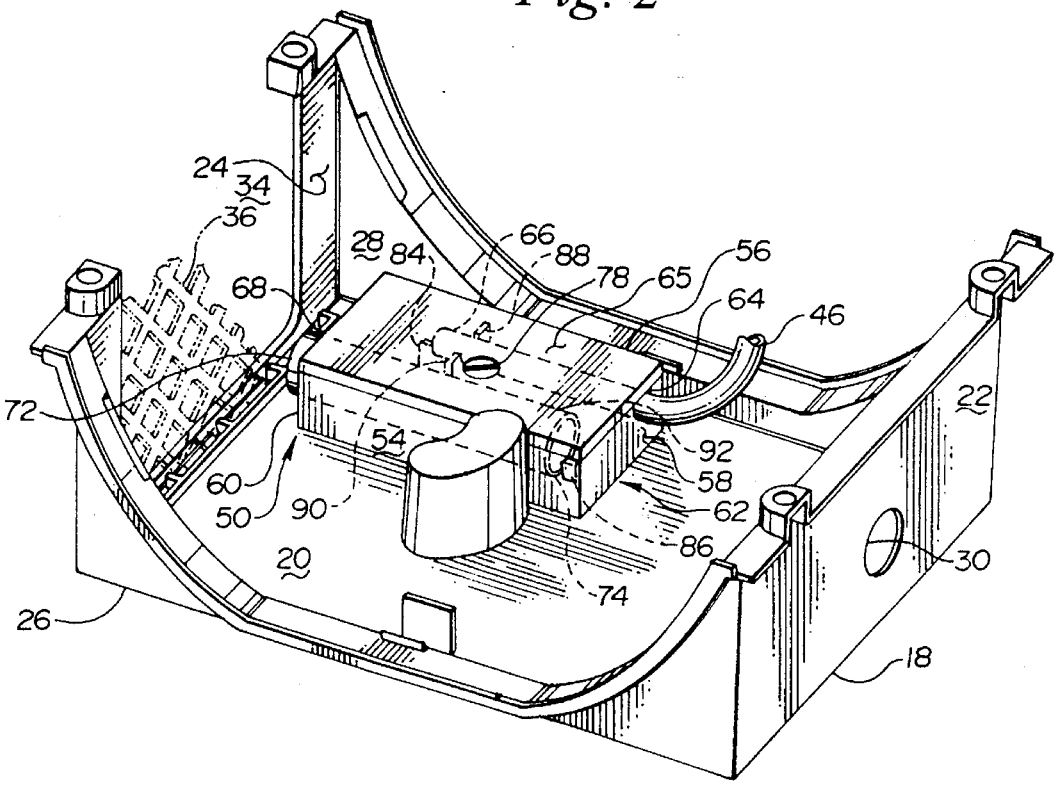
FIG. 2 is a perspective view of a portion of the turbine housing showing an aperture in the housing useful in connection with the present invention.
Figure 3:
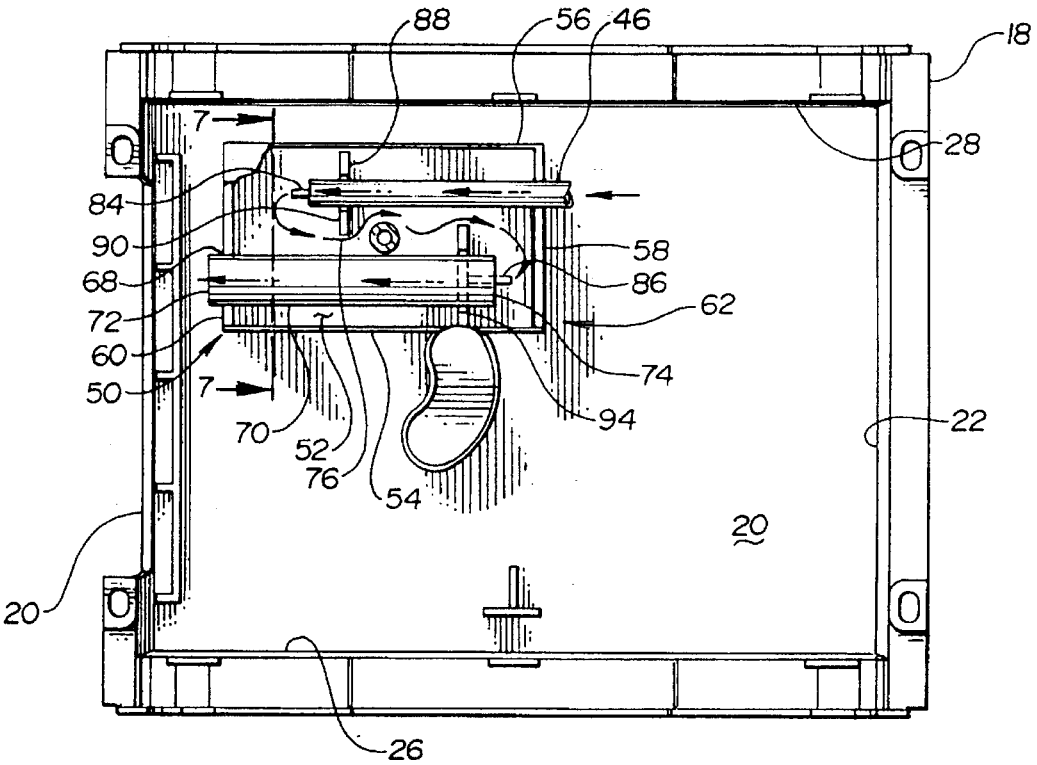
FIG. 3 is a top-plan view of the portion of the turbine housing shown in FIG. 2.

Referring now also to FIGS. 2 and 3, various views of a portion 18 of the turbine housing 11 may be seen. Portion 18 is preferably a solid support piece which may be an aluminum die casting having a lower planar surface 20, upstanding side walls 20, 22 and cutaway end walls 26, 28. Wall 22 preferably has an aperture 30 through which air outlet 16 projects and is secured by a decorative ring 32 which may have a knurled surface 33 at its periphery 35 to aid in rotating ring 32 onto air outlet 16 during assembly. Wall 20 preferably has a cutaway portion 34 covered by a screen 36 shown in FIG. 2 in phantom in a fragmentary view and shown from the exterior of turbine housing 10 in FIG. 4.

It is to be further understood that a second air intake at end 38 of turbine housing 11 provides for cooling air to enter housing 11 and cool the turbine motor with the cooling air exiting through cutaway portion 34.

Figure 4:
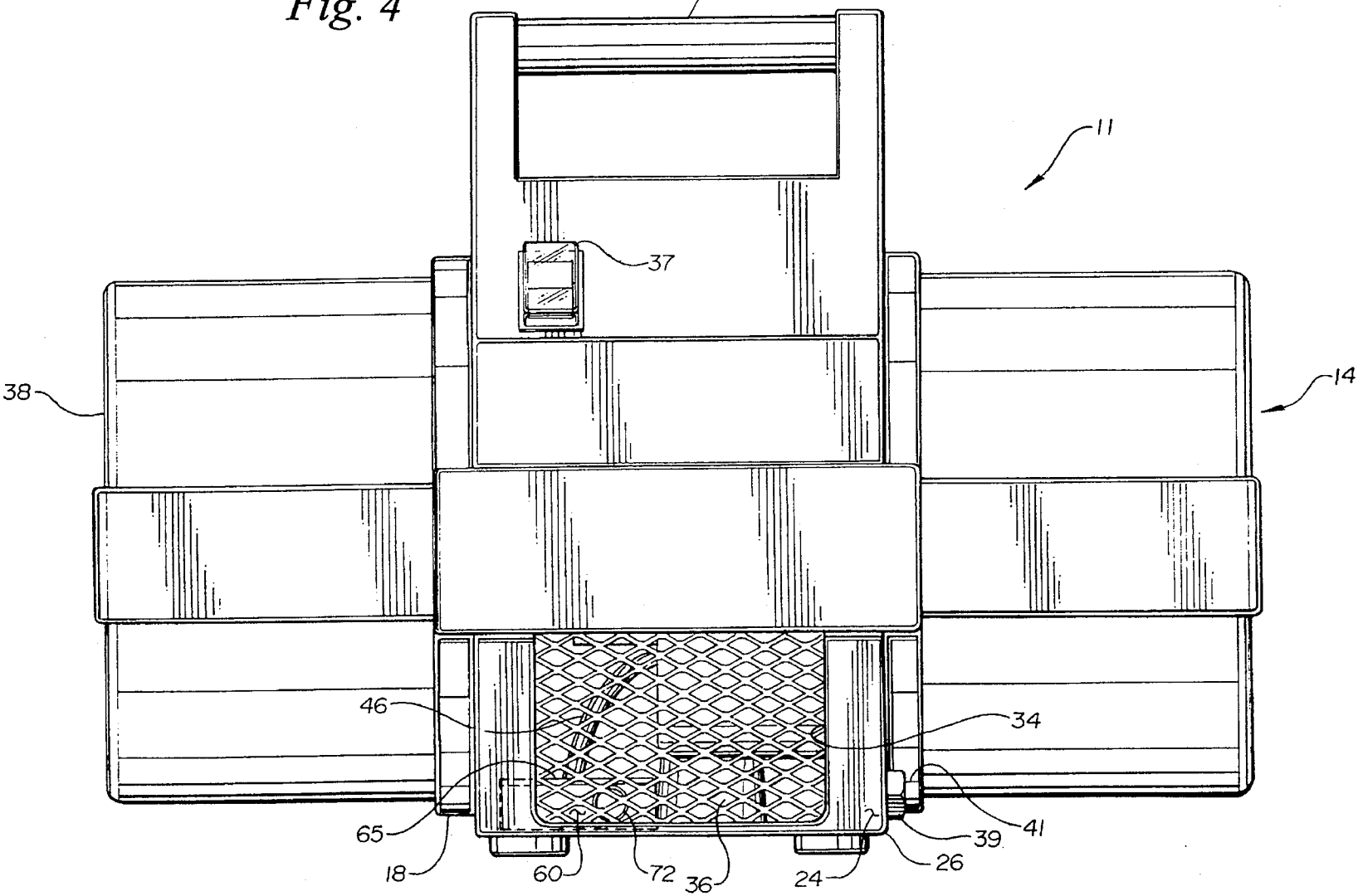
FIG. 4 is a rear elevation view of the turbine housing of FIG. 1.

Referring now also to FIG. 4, turbine housing 11 also preferably carries an on-off switch 37 and a strain relief 39 for a power cord 41.

Figure 5:
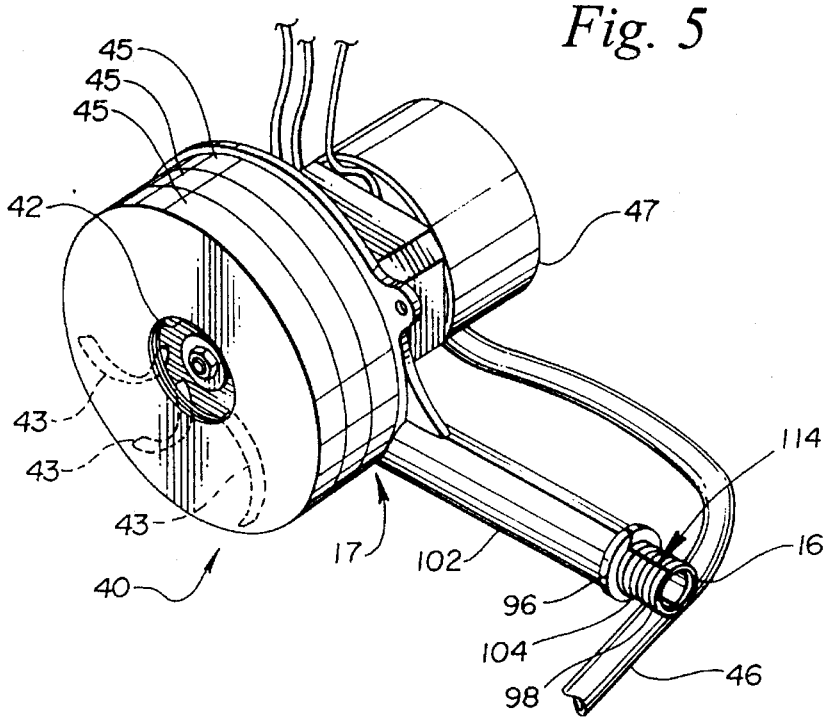
FIG. 5 is a perspective view of a turbine illustrating certain aspects of the present invention.

Referring now also to FIG. 5, the turbine 40 useful in the practice of the present invention may be seen. Turbine 40 has an air inlet 42 and a plurality of turbine blades 43 in a plurality of stages 45 to compress air before delivering it at outlet 16. A portion of air exiting the air outlet 16 is permitted to escape a bleed aperture 44 and is coupled to a hose or tube 46 by a conventional means such as a barbed fitting (not shown). It is to be understood that turbine 40 is powered by an electric motor 47.

Figure 6:
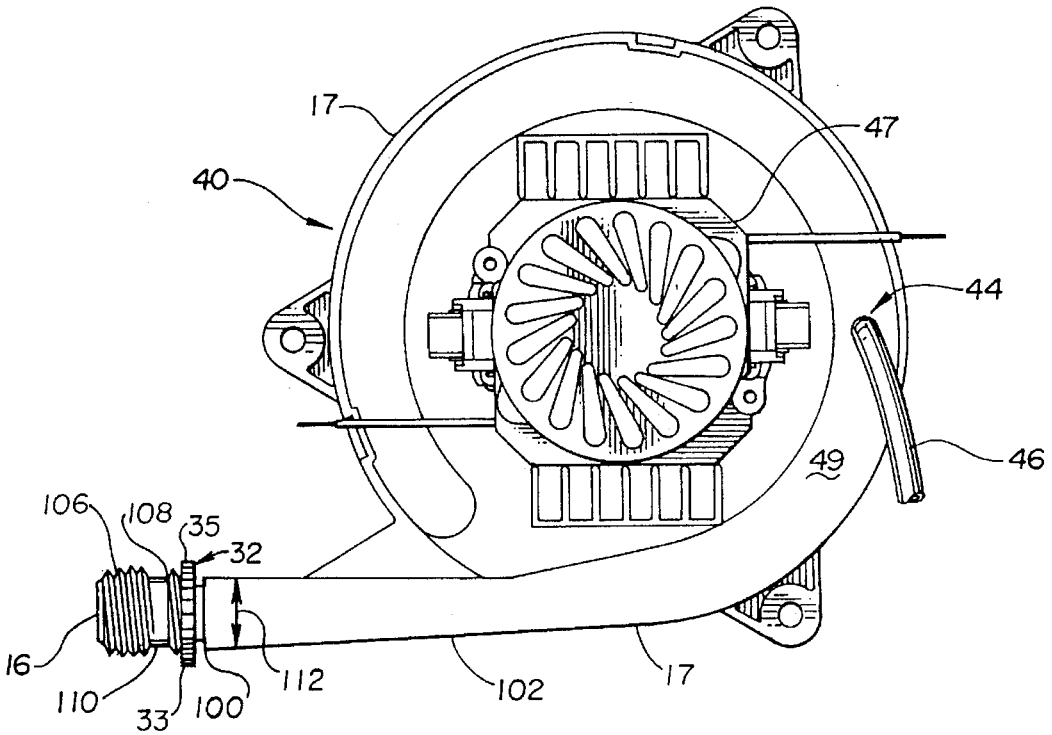
FIG. 6 is a side view of the turbine useful in the practice of the present invention.

Bleed aperture 44 is preferably formed by drilling and tapping a transverse hole in the outlet scroll 49 of turbine 40 and threading a barbed fitting into the threaded transverse hole. Tube or hose 46 is then received over the barbs of the fitting as shown in FIG. 6. The other end of inlet tube member 46 is shown in FIGS. 2 and 3.

Returning now to FIGS. 2 and 3, a first embodiment of the sound reducer enclosure 50 may be seen. Enclosure 50 preferably has a bottom wall 52, first and second spaced apart side walls 54, 56 and first and second spaced apart end walls 58, 60 forming a silencer housing 62. It is to be understood that silencer housing 62 is made up of bottom wall 52 side walls 54, 56 and end walls 58, 60. A cover 64 which is preferably planar forms a top wall which together with the silencer housing 62 forms the enclosure 50 and generally seals it.

The sound reducer enclosure 50 further includes an inlet aperture 64 in the first end wall 58 for receiving the inlet tube member 46, particularly, its outlet end 66 which carries bleed air venting from the turbine 40. Enclosure 50 also has an outlet aperture 68 in the second end wall 60. An outlet tube member 70 is preferably received in silencer housing 62 and passes through the outlet aperture 68 such that an outlet end 72 of the outlet tube member 70 is located exterior of the housing 62 in the region of the outlet aperture 68. Spacer means are located within the base for positioning the inlet tube member 46 and outlet tube member 70 in a spaced, parallel relationship such that the outlet 66 of the inlet tube member 46 is offset both longitudinally and transversely from the inlet end 74 of the outlet tube member 70 causing air exiting the outlet end 66 of the inlet tube member 46 to reverse direction and traverse a circuitous path indicated by arrows 76 within the housing 62 before entering the inlet end 74 of the outlet tube member 70. It is to be understood that cover 56 seals enclosure 50 sufficiently to require that the turbine bleed air is exhausted substantially via the outlet tube member 70. This results in high frequency noise present in the turbine bleed air to be substantially abated or silenced as the turbine bleed air exhausts from the outlet tube member 70. It is to be understood that the turbine bleed air eventually leaves the outlet end 72 of the outlet tube member 70 and passes through the cutaway portion 34 in sidewall 24 by passing through the apertures in screen 36.

It is further to be understood that a removable fastener such as screw 78 may be used to secure the cover 65 to the base or silencer housing 62.

Figure 7:
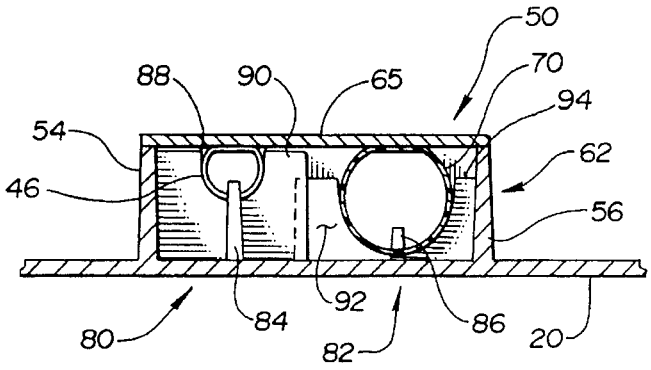
FIG. 7 is a section view taken along line 7—7 of FIG. 3.

In the embodiment shown in FIGS. 2 and 3 the spacers 80, 82 for the respective tube members 46, 70 are to be understood to be formed integrally with the base 62 as may be seen more clearly in FIG. 7. The spacers are further made up of yokes with each yoke located proximate an end of its respective tube member, being positioned within the housing 62 for preventing transverse movement of the respective tube members. As may be seen in FIGS. 2 and 3 this embodiment shows a silencer housing 62 formed integrally with a portion of the turbine enclosure 18. It may also be seen that the outlet end 72 of the outlet tube member 70 is positioned proximate the exhaust aperture 34 in the turbine enclosure 11.

The spacer means 80, 82 includes a pair of supports with one support 80 of the pair associated with the outlet end 66 of the inlet tube member 46 and the other support 82 of the pair associated with the inlet end 74 of the outlet tube member 70. Each support has respective upstanding side legs 88, 90 and 92, 94 adjacent its respective tube member, preventing transverse movement of that end of the respective tube member. Each support further includes a stop portion

84, 86 abutting the end of a tube member to prevent longitudinal movement of its respective tube member towards the nearest end wall. More particularly, stop portion or member 84 prevents end 66 of tube member 46 from longitudinal movement towards the second end wall 60 and stop member 86 prevents longitudinal movement of the outlet tube member 70 towards the first end wall 58.

Figure 11:
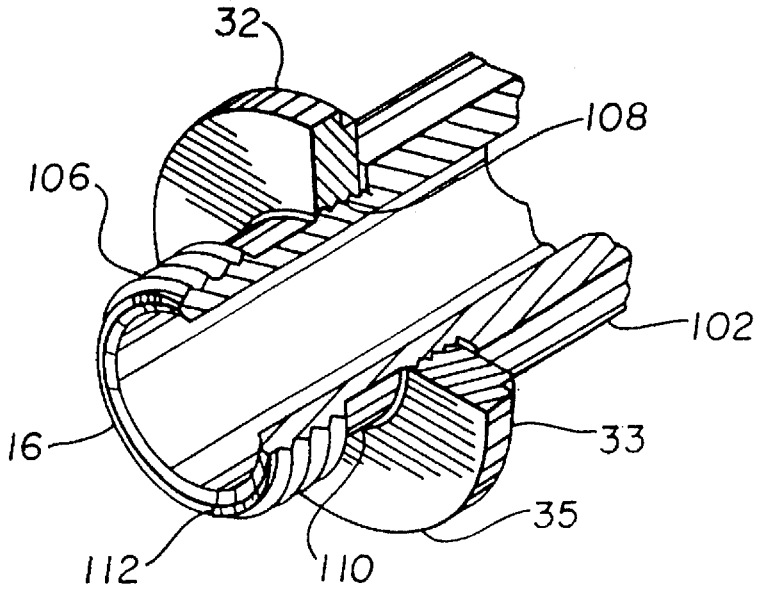
FIG. 11 is a fragmentary perspective view of the integrally threaded end of the outlet of the turbine shown in FIG. 6.
Figure 12:
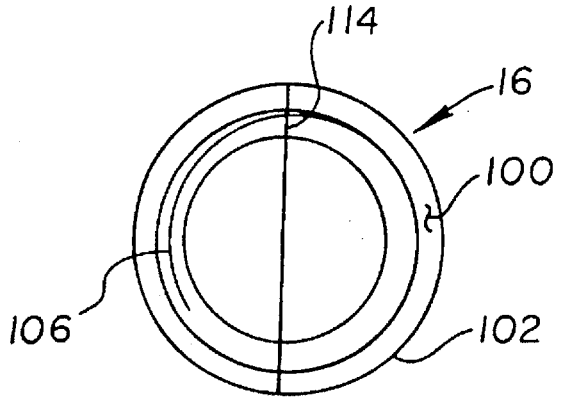
FIG. 12 is an end view of the integrally threaded end of the out of the turbine shown in FIG. 6 without the decorative ring.

Referring now most particularly to FIGS. 5 and 6, two slightly different versions of a turbine 40 useful in the practice of the present invention may be seen. In FIG. 5, the integrally threaded air outlet 16 has an enlarged flange or lip 96 immediately upstream of the threaded portion 98. Lip 96 is replaced by a radial step 100 in the version shown in FIG. 6. Both versions have an extension 102 projecting generally tangentially from the die cast turbine enclosure 17. It is to be understood that the diameter 112 of extension 102 is approximately equal to the diameter of the flexible hose (not shown) used to couple the air outlet 16 to a portable paint spray gun (also not shown). In the embodiments shown, the threads 104 may be continuous as shown in FIG. 5, or (as shown in FIGS. 6 and 11) they may be in two portions 106, 108 separated by a reduced diameter unthreaded intermediate portion 110. As may be seen most clearly in FIGS. 1, 6 and 11, the threads in portions 106,108 are preferably identical, to permit threading decorative ring 32 first over portion 106 and then tightening outlet 16 against housing portion 18 by drawing the threads of ring 32 against threaded portion 108, while step 100 (or flange 96) prevents housing portion 18 from moving along extension 102, it being understood that the aperture 30 in housing portion 18 is of a diameter less than the diameter of extension 102 (or flange 96). It is to be further understood that the threads of the integrally formed air outlet are preferably die cast along with the turbine enclosure 17. A parting line 114, shown most clearly in FIG. 12, illustrates that the enclosure may be cast in two parts, with the air outlet 16 being symmetrically formed thereby.

Referring again to FIGS. 2, 3, and 5, the present disclosure includes a method of silencing bleed air vented from a paint sprayer turbine from the type for use with non-bleeder paint spraying guns having the steps of directing turbine bleed air vented from the turbine 40 from within an inlet tube member 46 located within a generally closed or sealed sound reducer enclosure 50, passing the turbine bleed air along the exterior of the inlet tube member 46 (as shown by arrows 76) within the sound reducer enclosure 50, receiving the turbine bleed air into an outlet tube member 70 located partially within the sound reducing enclosure 50 and positioned generally parallel to and offset longitudinally and transversely from the inlet tube member 46 and finally, exhausting the turbine bleed air from the sound reducer enclosure 50 via the outlet tube member 70 such that high frequency noise present in the turbine bleed air as it exits the inlet tube member 46 is substantially abated as it exhausts from the outlet tube member 70 at its outlet 72. It may be noted, with particular reference to FIG. 3, that when the air passes from the inlet tube member 46 to the outlet tube member 70, it moves in a direction opposite to the direction of the air exiting the inlet tube member 46 and that once the air enters the outlet tube member 70 it moves in a direction parallel to and in the same sense as the direction of the air in the inlet tube member 46. To ensure that this occurs, the method further includes retaining the inlet tube member 46 and outlet tube member 70 in the enclosure 50 between a removable cover 65 and a base 62.

Figure 8:
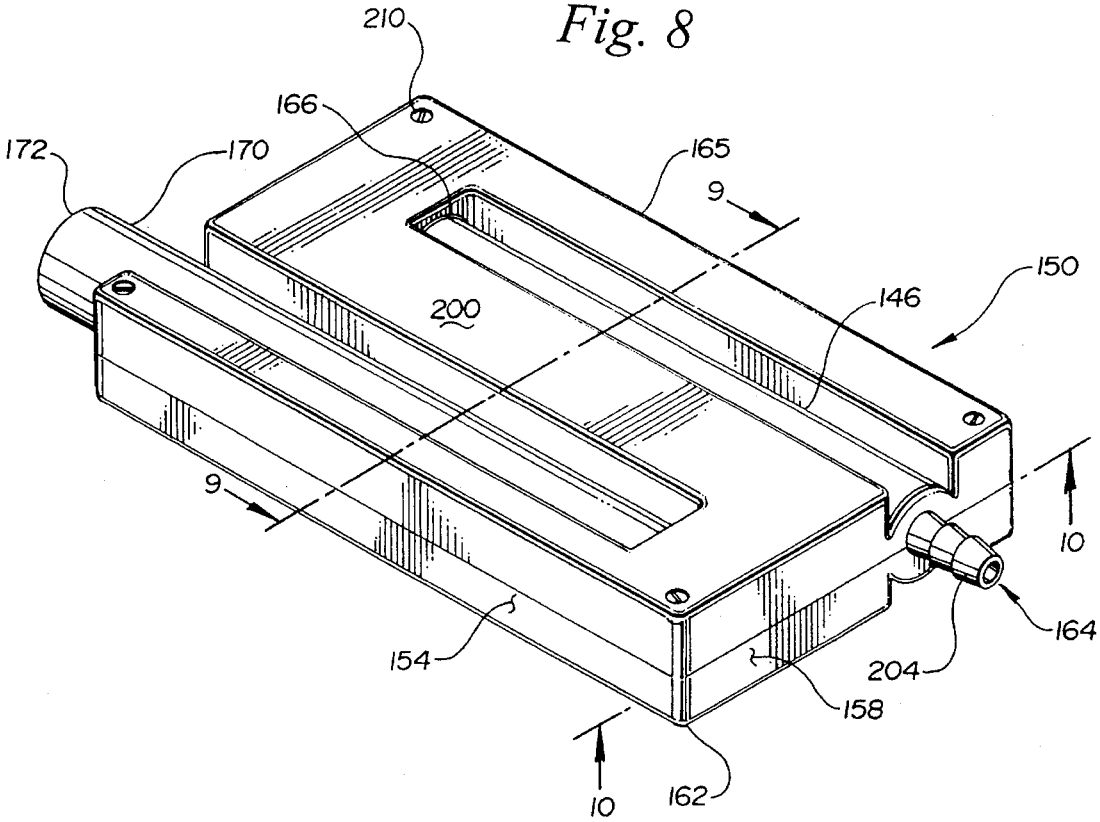
FIG. 8 is a perspective view of an alternative embodiment of a sound reducer enclosure useful in connection with the turbine of the present invention.
Figure 10:
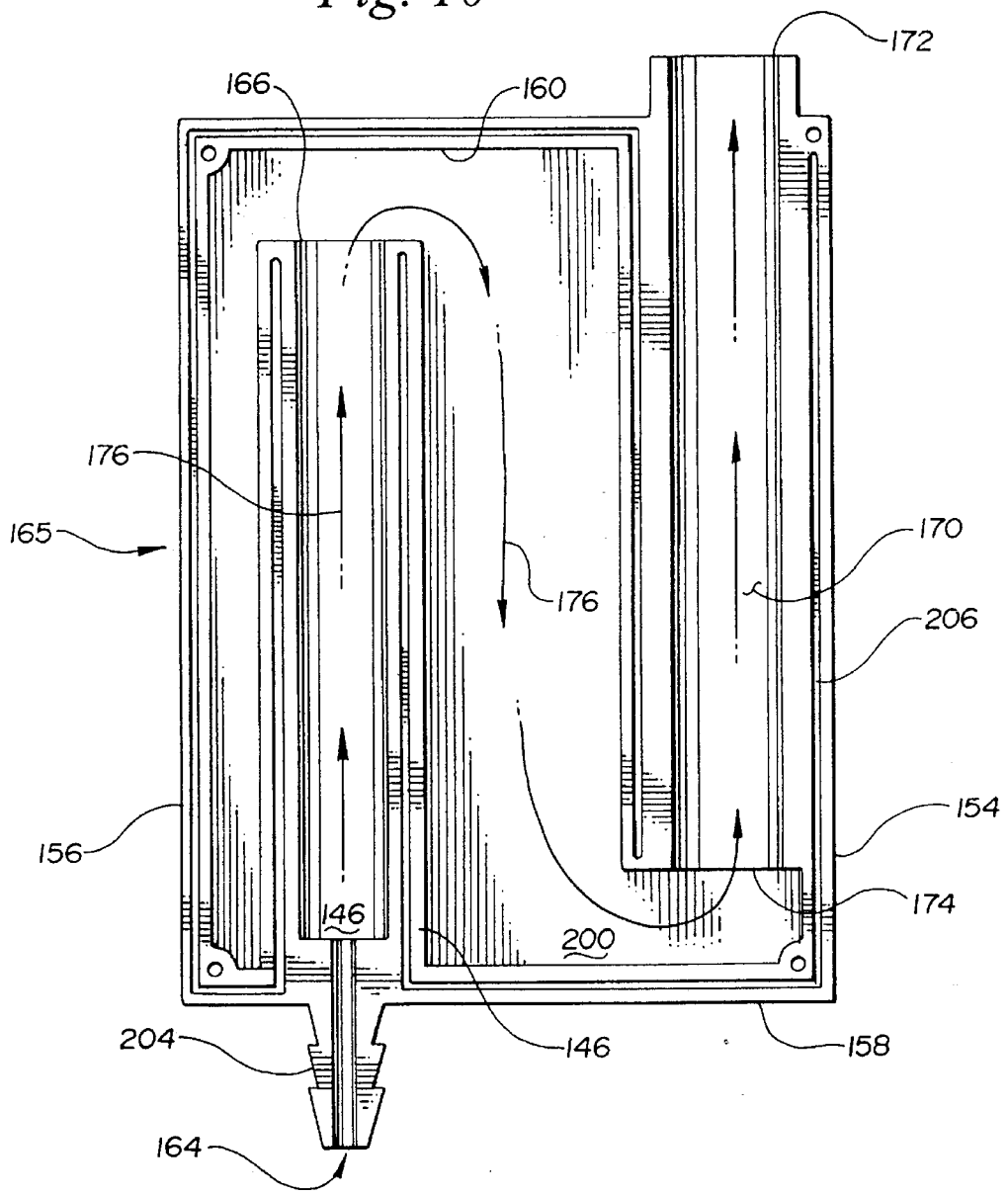
FIG. 10 is a view of the interior of the cover member taken along line 10—10 of FIG. 8.
Figure 9:
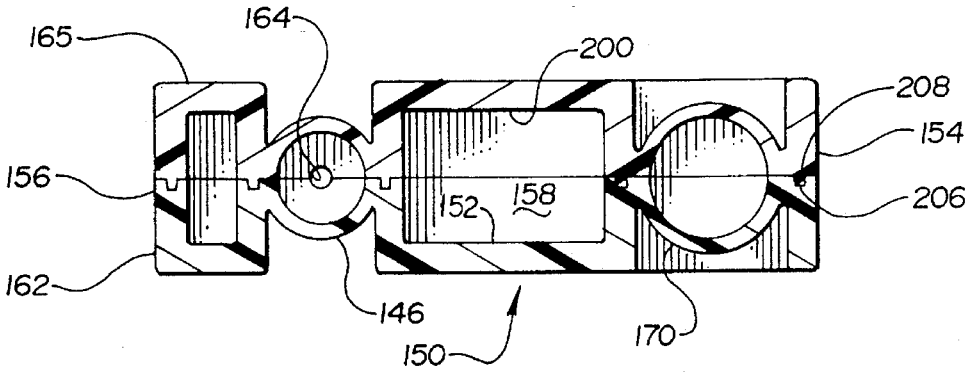
FIG. 9 is a section view taken along line 9—9 of FIG. 8.

As may be seen in FIGS. 8, 9 and 10, a silencer housing may be formed separate from the turbine enclosure. In such an embodiment at least one (and preferably both) of the inlet and outlet tube members may be formed integrally with the base and cover. In each embodiment, the inlet tube member preferably has a smaller diameter than the outlet tube member.

It is to be understood that corresponding reference numbers offset by 100 are used for like parts of this second or alternative embodiment of the silencer housing 150. In this embodiment the sound reducer enclosure 150 is independent of the turbine housing 11. In the embodiment shown, both an inlet tube member 146 and an outlet tube member 170 are formed, preferably by injection molding, internally as a part of enclosure 150. Enclosure 150 has a bottom wall 152, a pair of side walls 154, 156, and a first end wall 158 and a second end wall 160. An inlet aperture 164 of enclosure 150 is formed in a bifurcated barbed fitting 204. Enclosure 150 is to be understood to be made up of a cover or top portion 165 and a base or bottom portion 162. In the embodiment shown, one-half of the outlet tube member 170 is formed as a part of top 165 and the other half of outlet tube member 170 is formed as a part of base portion 162. As in the previously described embodiment, outlet end 172 of outlet tube member 170 projects beyond the periphery or exterior of the silencer enclosure 150 and is preferably to be located adjacent cutaway portion 34 in the turbine housing 11 to permit the turbine bleed air to escape unhindered. Outlet tube member 170 also has an inlet end 174 offset both longitudinally and transversely within enclosure 150 from an outlet end 166 Of inlet tube member 146. Because of this, turbine bleed air entering the inlet aperture 164 progresses through inlet tube member 146 and reverses direction (as indicated by arrows 176) before entering the inlet end 174 of outlet tube member 170. Cover 164 preferably has a top wall 200 and a rib or tongue 206 adapted to mate with a groove 208 in base or bottom portion 162 to maintain registration and alignment of the cover 165 with the base 162. One or more fasteners 210 (such as self-tapping screws), may be provided to retain cover portion 165 and base portion 162 together. Furthermore, these same fasteners (or other fasteners, not shown) may be used to secure enclosure 150 to turbine housing portion 18, if desired.

The invention is not to be taken as limited to all of the details thereof as modifications and variations thereof may be made without departing from the spirit or scope of the invention.

What is claimed is:

1. An improved air outlet for portable paint spraying equipment of the type having a die cast turbine enclosure, the improved air outlet comprising a die cast extension of the turbine enclosure integrally formed therewith and having a die cast threaded end extending therefrom for direct coupling to a flexible hose used to provide atomizing air for a high volume low pressure portable paint spray gun, the extension projecting generally tangentially of the turbine enclosure and having a diameter approximately equal to the flexible hose to be coupled thereto and wherein the threaded end has a proximal threaded portion and a distal threaded portion separated by a reduced diameter unthreaded intermediate portion.

2. The improved air outlet of claim 1 further comprising a decorative ring having threads matingly received on the threaded end of the projecting extension for retaining the turbine enclosure in a surrounding housing.

3. The improved air outlet of claim 1 wherein the threads of the proximal and the distal portions are identical.

4. The improved air outlet of claim 1 wherein the projecting extension further comprises a radial step between the threaded end and an unthreaded portion of the projecting extension.

5. The improved air outlet of claim 4 further comprising a decorative ring having threads matingly received on the threaded end of the projecting extension and a turbine housing retained between the decorative ring and the radial step of the projecting extension.

* * * * *